United States Patent [19]

Herren, Jr.

[11] Patent Number: 4,526,105

[45] Date of Patent: Jul. 2, 1985

[54] FIRING MECHANISM FOR PROJECTILES

[76] Inventor: Thomas W. Herren, Jr., 6611 Dearborn Dr., Falls Church, Va. 22044

[21] Appl. No.: 516,405

[22] Filed: Jul. 22, 1983

[51] Int. Cl.[3] ..... F42B 13/20

[52] U.S. Cl. ..... 102/498; 102/230; 102/274; 102/342; 102/351; 102/395; 244/3.3

[58] Field of Search ..... 102/223, 224, 229, 230, 102/274, 269, 340, 342, 351, 357, 374, 379, 395, 398, 489, 499, 498, 473, 529, 501; 244/3.24, 3.26, 3.3

[56] References Cited

U.S. PATENT DOCUMENTS

| | | | |
|---|---|---|---|
| 1,309,768 | 7/1919 | Newell | 102/274 |
| 2,344,957 | 3/1944 | Anzalone | 244/3.26 |
| 2,397,114 | 3/1946 | Anzalone | 102/340 |
| 2,804,823 | 9/1957 | Jablansky | 102/377 |
| 3,718,093 | 2/1973 | Milanowski et al. | 102/395 |

*Primary Examiner*—Harold J. Tudor

*Attorney, Agent, or Firm*—Pollock, Vande Sande and Priddy

[57] ABSTRACT

A firing mechanism for projectiles comprises a housing (42) having a bore (50) in which a firing pin (54) is slidably mounted under the influence of a spring (70). Leaf springs (72) formed in the housing wall hold the firing pin in a safety position until released by movement of a slider (82) caused by aerodynamic drag forces acting on deployable fins (96) or a parachute (92).

20 Claims, 5 Drawing Figures

FIRING MECHANISM FOR PROJECTILES

DESCRIPTION

TECHNICAL FIELD

The present invention concerns firing mechanisms for use in ordnance such as artillery projectiles and bombs. More particularly, the invention concerns such a firing mechanism which is especially suited for use in cannon-fired or aircraft-dropped projectiles such as those used to simulate indirect fire during combat training exercises.

BACKGROUND ART

In attempts to simulate actual combat conditions during training exercises for ground troops, a variety of devices has been tried over the years to provide a relatively realistic combat environment including the sound, flash and smoke of artillery rounds and bombs. Remotely detonated explosive charges, hand-thrown artillery simulators and launchers for small sound and flash devices have been used. In such cases, any device used to simulate indirect fire preferably has been configured so that fragments released upon detonation will not injure personnel participating in the training exercise. A particularly effective type of device for simulating indirect fire is disclosed in the present applicant's copending application Ser. No. 421,555 filed Sept. 21, 1982, now abandoned, for Indirect Fire Simulation Devices.

Since in most cases no portion of such simulation devices is intended for reuse, minimization of manufacturing costs has presented a continuing problem. Moreover, since any fragments or intact portions of such devices following detonation could present a serious missle hazzard to training personnel, the use of lightweight materials or the use of recovery devices such as parachutes for large intact portions or both has become most desirable. In addition to maintaining the safety of training personnel and minimizing the cost of the simulation devices, a continuing need has existed for simulation devices having firing mechanisms which not only meet safety and cost requirements but are also simple and highly reliable during training exercises.

DISCLOSURE OF THE INVENTION

The primary object of this invention is to provide an improved firing mechanism for projectiles such as those used for indirect fire simulation during training exercises.

A further object of the invention is to provide such a firing mechanism which is inexpensive and reliable and includes provision for safely bringing to the ground those portions of its structure not destroyed upon detonation.

Yet another object of the invention is to provide such a firing mechanism which is suitable for use in projectiles to be launched from a conventional cannon or fired from an aircraft.

These objects of the invention are given only by way of example; therefore, other desirable objectives and advantages inherently achieved by the disclosed invention may occur or become apparent to those skilled in the art. Nonetheless, the scope of the invention is to be limited only by the appended claims.

A projectile of a type suitable for a firing mechanism according to the invention comprises an elongated tubular body having a forward chamber and an aft chamber with a propellant grain of known composition positined in the aft chamber. Means are provided beween the aft chamber and the forward chamber for permitting passage of combustion gases from the aft chamber into the forward chamber as the propellant grain burns out during flight of the projectile. A nose portion, such as the rigid urethane foam nose portion disclosed in copending application Ser. No. 421,555, is slidably received at least partially in the forward chamber so that it will be expelled from the forward chamber by combustion gases coming from the aft chamber during flight. An explosive charge for simulating the sound, light and smoke of an actual artillery shell or bomb and a primer are included in the nose portion.

The firing mechanism according to the invention includes a housing having a central bore, the housing being attached to the nose portion so that its bore opens at the primer. A firing pin is slidably received in the bore and biased toward the primer by a suitable spring. The wall of the housing supports at least one resilient detent member which is normally biased to a radially outward position out of engagement with the firing pin. To prevent release of the firing pin during launch and before the propellant grain burns out during flight, a slider means is provided for forcing the resilient detent member radially inwardly to engage and hold the firing pin against the action of the spring. Upon expulsion of the nose portion from the body of the projectile, means are actuated for moving the slider relative to the detent member to release the detent member from engagement with the firing pin so that the firing pin is driven into the primer by the spring and the explosive charge is detonated.

In the preferred embodiment, the resilient detent member comprises a cantilevered leaf spring formed in the wall of the housing, the spring having a radially inwardly projecting portion which engages and holds the firing pin when the leaf spring is forced inwardly by the slider means. Also in the preferred embodiment, the slider means comprises a sleeve surrounding the housing, the sleeve having at least one aperture which engages a further, radially outwardly projecting portion of the leaf spring to prevent further movement of the sleeve following release of the firing pin. The means for moving the slider to release the firing pin may be a plurality of aerodynamically deployable fins attached to the slider or a parachute which is deployed from the body of the projectile during flight.

BEST MODE FOR CARRYING OUT THE INVENTION

Figure 1:
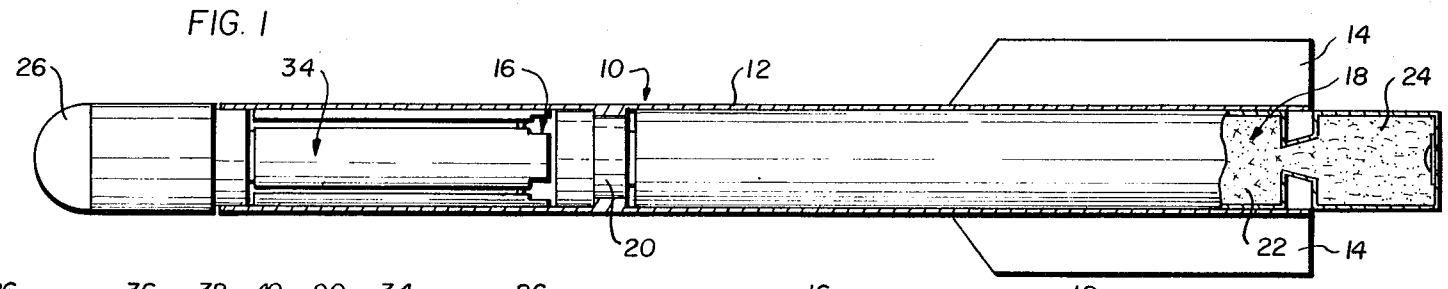
FIG. 1 shows an elevation view, partially in section, of a projectile of the type suited for use with a firing mechanism according to the present invention.

The following is a detailed description of a preferred embodiment of the invention, reference being made to the drawings in which like reference numerals identify like elements of structure in each of the several Figures.

A projectile 10 of the type suitable for use with a firing mechanism according to the invention is configured for launching from a conventional cannon or firing from an aircraft. The projectile comprises an elongated tubular body 12 which may be made from thin-walled steel and includes a plurality of stabilizing fins 14 in the familiar manner. The interior of tubular body 12 is divided into a forward chamber 16 and an aft chamber 18 by a pressure rupturable separator 20 of known design. A propellant grain 22 is positioned in aft chamber 18 and a suitable igniter 24 is provided at the aft end of body 12. Chamber 16 is closed by a nose portion 26 formed of a suitable rigid plastic such as the rigid polyurethane foam disclosed in the applicant's copending application Ser. No. 421,555. Within nose portion 26, an explosive charge 28 for simulating the sound, flash and smoke of combat conditions is provided. A primer 30 and a time delay fuse 32 complete the pyrotechnic components of nose portion 26. In some applications, nose portion 26 and charge 28 may be replaced by a suitable aerial flare device.

Aft of nose portion 26 is attached the firing mechanism 34 according to the invention. The mechanism comprises a molded plastic, cup-shaped body 36 within which nose portion 26 is fitted. The aft wall 38 of cup-shaped body 36 includes a central opening 40 through which primer 30 is accessible. Extending aft from wall 38 is a molded plastic firing pin housing 42 which preferably comprises a forward cylindrical part 44 formed integrally with aft wall 38 and an aft cylindrical part 46 joined to forward part 44 by a suitable fastener 48 such as a snap or threaded joint. Thus, a stepped bore 50 is defined within firing pin housing 42, the axis of the bore being aligned with primer 30. An aft wall 52 closes cylindrical part 46.

Within housing 42 is positioned a firing pin 54 of suitable hard plastic or metal. Pin 54 includes a pointed tip 56 for striking primer 30. Aft of tip 56, a radially outwardly protruding portion 58 is provided which includes a tapered forward surface 60 and a flat aft surface 62. Between radially outwardly protruding portion 58 and tip 56, a forward cylindrical portion 64 slides within a reduced diameter portion 66 of stepped bore 50 so that firing pin 54 is guided toward primer 30 in operation. Aft of protruding portion 58, a cylindrical portion 68 is surrounded by a coil spring 70 which bears on aft wall 52 and flat surface 62 to bias firing pin 54 toward primer 30.

Figure 2:
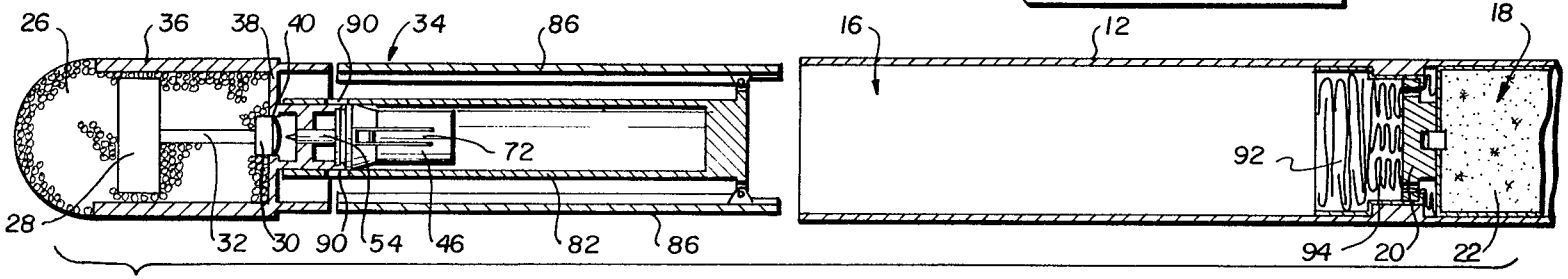
FIG. 2 shows an enlarged elevation view, partially in section, of the forward portion of such a projectile just after the nose portion has been expelled during flight.
Figure 3:
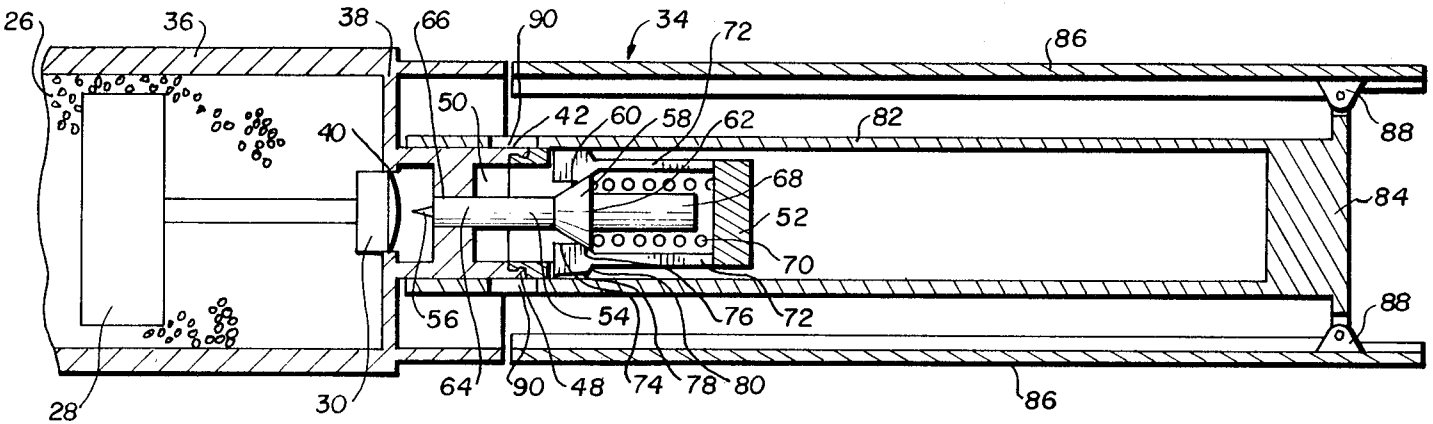
FIG. 3 shows a further enlarged sectional view of the firing mechanism according to the invention, prior to aerodynamic deployment of its fins.
Figure 4:
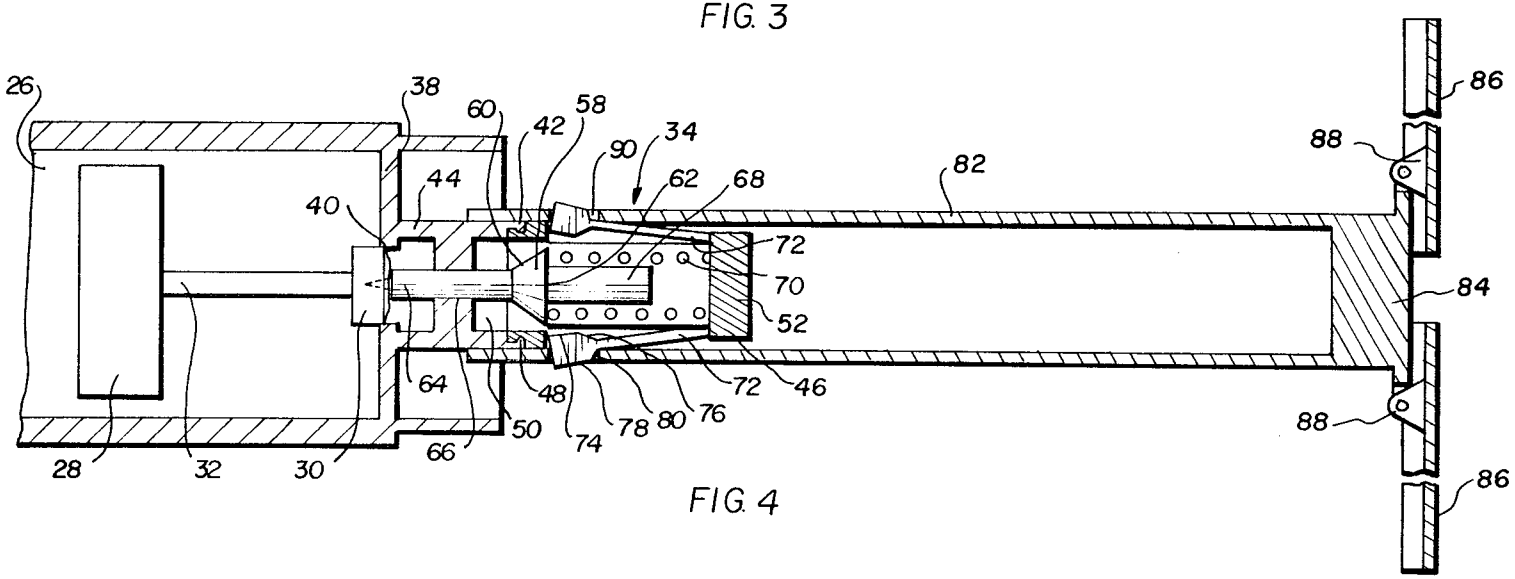
FIG. 4 shows an enlarged sectional view of the firing mechanism after deployment of its fins and release of the firing pin.

The wall of cylindrical part 46 is formed integrally with two or more cantilevered leaf springs 72 which as formed are normally biased radially outwardly out of contact with firing pin 54. Each leaf spring 72 preferably is parallel to firing pin 54 and comprises a radially inwardly projecting portion 74 having an angled surface 76 for engaging tapered surface 60 of firing pin 54 when the spring is deflected inwardly. Each leaf spring 72 also comprises a radially outwardly projecting portion 78 having on its aft surface a radially projecting stop surface 80. Surrounding firing pin housing 42 and slidable therealong is a sleeve 82, seen most clearly in FIGS. 3 and 4. In its forward, safety position, sleeve 82 forces leaf springs 72 radially inwardly so that they engage and hold firing pin 54 against the action of spring 70, as shown in FIG. 3. At the aft end 84 of sleeve 82, a plurality of aerodynamically deployable drag fins 86 are attached by means of a corresponding plurality of pivots 88. At the forward end of sleeve 82, apertures 90 are provided for receiving outwardly projecting portions 78 and engaging stop surfaces 80 when sleeve 82 moves aft to the position illustrated in FIG. 4, as will shortly be described. As shown in FIGS. 1 and 2, a parachute 90 is positioned within forward chamber 16 between pressure rupturable separator 20 and firing mechanism 34. The parachute is attached to body 12 by means of suitable shroud line 94.

In operation, a projectile of the type shown in FIGS. 1–4 is launched or fired by activating igniter 24 which in turn fires propellant grain 22 to propel the projectile to the area where training exercises are being conducted. When propellant grain 22 has burned forward to the location of separator 20, the combustion gases cause separator 20 to rupture so that gases expand into forward chamber 16, causing nose portion 26, firing mechanism 34, parachute 92 and often separator 20 to be ejected from forward chamber 16. The parachute deploys so that the tubular body 12 of the projectile is floated safely to the ground. At the same time, fins 86 are swept outwardly to the position illustrated in FIG. 4 by the flow of air past firing mechanism 34. The aerodynamic drag on fins 86 then causes sleeve 82 to slide aft to the position shown in FIG. 4 so that leaf springs 72 are free to spring outwardly causing stop surfaces 80 to engage apertures 90 and releasing firing pin 54 which flies forward under the influence of spring 70 and impacts primer 30.

Figure 5:
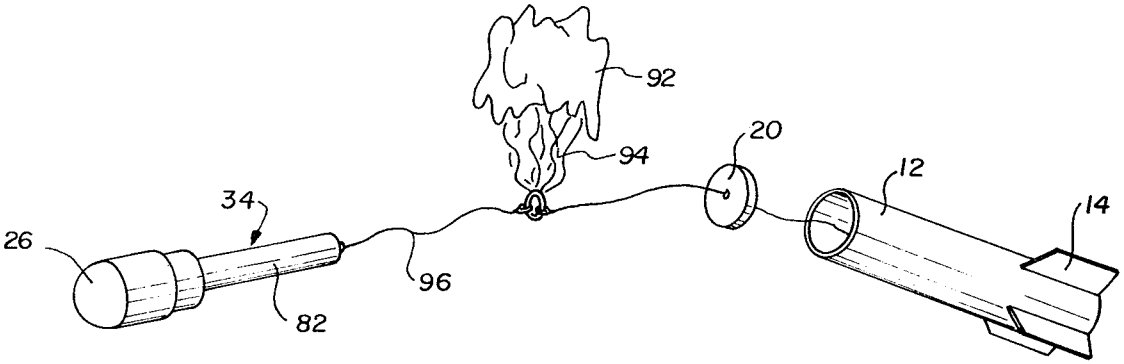
FIG. 5 shows a schematic perspective view of a projectile embodying a firing mechanism according to the invention in which both the body of the projectile and the firing mechanism are attached to a parachute.

FIG. 5 illustrates an alternative configuration of a projectile according to the invention in which aerodynamically deployable fins 86 are omitted and parachute 92 is tethered to slider 82 by a suitable line 96. In this embodiment, the drag of the parachute causes slider 82 to move aft to the position illustrated in FIG. 4. Otherwise, the operation of the embodiment of FIG. 5 is identical to that previously described.

Having described my invention in sufficient detail to enable those skilled in the art to make and use it, I claim:

1. An improved projectile, comprising:

an elongated tubular body having a forward chamber and an aft chamber;

a propellant grain positioned in said aft chamber;

means separating said aft chamber from said forward chamber for permitting passage of combustion gases from said aft chamber into said forward chamber as said propellant grain burns out during flight of said projectile;

a nose portion slidably received at least partially in said forward chamber and adapted to be expelled from said forward chamber by said combustion gases, said nose portion comprising an explosive charge and a primer for said explosive charge;

a housing having a bore, said housing being attached to said nose portion so that said bore opens at said primer;

a firing pin slidably received in said bore;

spring means for biasing said firing pin toward said primer;

at least one resilient detent member attached to said housing, said detent member being normally biased to a radially outward position out of engagement with said firing pin;

slider means for forcing said at least one resilient detent member radially inwardly to engage and hold said firing pin against the action of said spring means in a safety position away from said primer; and means actuated upon expulsion of said nose portion for moving said slider means relative to said detent member to release said detent member from engagement with said firing pin, whereby said firing pin is driven into said primer by said spring means.

2. A projectile according to claim 1, wherein said means for moving said slider means comprises a plurality of fins pivotably attached to the aft end of said slider means, said fins being deployable by aerodynamic forces upon expulsion of said nose portion to radially outwardly extended positions in which drag forces cause said slider means to move relative to said detent member.

3. A projectile according to claim 1, wherein said means for moving said slider means comprises a parachute attached to said slider means, said parachute being deployable upon expulsion of said nose portion so that drag forces cause said slider means to move relative to said detent member.

4. A projectile according to claim 3, wherein said parachute also is attached to said tubular body.

5. A projectile according to claim 1, wherein said housing is tubular and said at least one resilient detent member comprises a cantilevered leaf spring formed in the wall of said housing, said leaf spring having a radially inwardly projecting portion for engaging and holding said firing pin when said leaf spring is forced inwardly by said slider means.

6. A projectile according to claim 5, wherein said leaf spring extends parallel to said firing pin.

7. A projectile according to claim 5, wherein said slider means comprises a sleeve surrounding said housing, said sleeve having at least one aperture therein; and said leaf spring comprises a radially outwardly projecting portion for engaging said aperture to prevent further movement of said sleeve following release of said firing pin.

8. A projectile according to claim 5, wherein said firing pin comprises a radially outwardly projecting portion for engaging said inwardly projecting portion of said leaf spring.

9. A projectile according to claim 8, wherein said spring means bears against said radially outwardly projecting portion of said firing pin.

10. A projectile according to claim 1, wherein said housing is tubular; said at least one resilient detent member comprises a cantilevered leaf spring formed in the wall of said housing, said leaf spring having a radially inwardly projecting portion for engaging and holding said firing pin when said leaf spring is forced inward by said slider means, said leaf spring further having a radially outwardly projecting portion; said slider means comprises a sleeve surrounding said housing, said sleeve having at least one aperture therein for receiving said outwardly projecting portion of said leaf spring to prevent further movement of said sleeve following release of said firing pin; said firing pin comprises a radially outwardly projecting portion for engaging said inwardly projecting portion of said leaf spring; and said spring means bears against said radially outwardly projecting portion of said firing pin.

11. An improved firing mechanism for a projectile of the type having a nose portion which separates in flight from the remainder of the projectile and which includes an explosive charge and a primer for said explosive charge, said mechanism comprising:

a housing having a bore, said housing being adapted for attachment to said nose portion so that said bore opens at said primer;

a firing pin slidably received in said bore, spring means for biasing said firing pin toward said primer;

at least one resilient detent member attached to said housing, said detent member being normally biased to a radially outward position out of engagement with said firing pin;

slider means for forcing said at least one resilient detent member radially inwardly to engage and hold said firing pin against the action of said spring means in a safety position away from said primer; and means actuated upon separation of said nose portion for moving said slider means relative to said detent member to release said detent member from engagement with said firing pin, whereby said firing pin is driven into said primer by said spring means.

12. A mechanism according to claim 11, wherein said means for moving said slider means comprises a plurality of fins pivotably attached to the aft end of said slider means, said fins being deployable by aerodynamic forces upon expulsion of said nose portion to radially outwardly extended positions in which drag forces cause said slider means to move relative to said detent member.

13. A mechanism according to claim 11, wherein said means for moving said slider means comprises a parachute attached to said slider means, said parachute being deployable upon expulsion of said nose portion so that drag forces cause said slider means to move relative to said detent member.

14. A mechanism according to claim 13, wherein said parachute also is adapted to be attached to said remainder of said projectile.

15. A mechanism according to claim 11, wherein said housing is tubular and said at least one resilient detent member comprises a cantilevered leaf spring formed in the wall of said housing, said leaf spring having a radially inwardly projecting portion for engaging and holding said firing pin when said leaf spring is forced inwardly by said slider means.

16. A mechanism according to claim 15, wherein said leaf spring extends parallel to said firing pin.

17. A mechanism according to claim 15, wherein said slider means comprises a sleeve surrounding said housing, said sleeve having at least one aperture therein; and said leaf spring comprises a radially outwardly projecting portion for engaging said aperture to prevent further movement of said sleeve following release of said firing pin.

18. A mechanism according to claim 15, wherein said firing pin comprises a radially outwardly projecting portion for engaging said inwardly projecting portion of said leaf spring.

19. A projectile according to claim 18, wherein said spring means bears against said radially outwardly projecting portion of said firing pin.

20. A projectile according to claim 11, wherein said housing is tubular; said at least one resilient detent member comprises a cantilevered leaf spring formed in the wall of said housing, said leaf spring having a radially inwardly projecting portion for engaging and holding said firing pin when said leaf spring is forced inward by said slider means, said leaf spring further having a radially outwardly projecting portion; said slider means comprises a sleeve surrounding said housing, said sleeve having at least one aperture therein for receiving said outwardly projecting portion of said leaf spring to prevent further movement of said sleeve following release of said firing pin; said firing pin comprises a radially outwardly projecting portion for engaging said inwardly projecting portion of said leaf spring; and said spring means bears against said radially outwardly projecting portion of said firing pin.

* * * * *